US011367967B2

(12) United States Patent
Ren et al.

(10) Patent No.: US 11,367,967 B2
(45) Date of Patent: Jun. 21, 2022

(54) COMPACT 5G MIMO ANTENNA SYSTEM AND MOBILE TERMINAL

(71) Applicant: SHENZHEN SUNWAY COMMUNICATION CO., LTD., Guangdong (CN)

(72) Inventors: Zhouyou Ren, Shenzhen (CN); Anping Zhao, Shenzhen (CN)

(73) Assignee: SHENZHEN SUNWAY COMMUNICATION CO., LTD., Shenzhen (CN)

( * ) Notice: Subject to any disclaimer, the term of this patent is extended or adjusted under 35 U.S.C. 154(b) by 271 days.

(21) Appl. No.: 16/492,747

(22) PCT Filed: Jun. 13, 2019

(86) PCT No.: PCT/CN2019/091054

§ 371 (c)(1),
(2) Date: Sep. 10, 2019

(87) PCT Pub. No.: WO2020/177231

PCT Pub. Date: Sep. 10, 2020

(65) Prior Publication Data

US 2021/0359426 A1 Nov. 18, 2021

(30) Foreign Application Priority Data

Mar. 1, 2019 (CN) ..... 201910155803.7
Mar. 1, 2019 (CN) ..... 201910156232.9
(Continued)

(51) Int. Cl.
*H01Q 21/29* (2006.01)
*H01Q 5/20* (2015.01)
(Continued)

(52) U.S. Cl.
CPC ..... *H01Q 21/29* (2013.01); *H01Q 1/48* (2013.01); *H01Q 1/52* (2013.01); *H01Q 5/20* (2015.01); *H01Q 5/50* (2015.01)

(58) Field of Classification Search
CPC ..... H01Q 21/28–29; H01Q 5/30–50; H01Q 1/243; H01Q 1/48–52; H01Q 1/22–52
See application file for complete search history.

(56) References Cited

U.S. PATENT DOCUMENTS 6,507,322 B2 * 1/2003 Fang ..... H01Q 21/24 343/702
10,044,110 B2 8/2018 Dong et al.
(Continued)

FOREIGN PATENT DOCUMENTS

CN 105379008 A 3/2016
CN 109861000 A 6/2019

OTHER PUBLICATIONS

Nov. 15, 2019 International Search Report issued in International Patent Application No. PCT/CN2019/091054.

*Primary Examiner* — Hasan Z Islam
(74) *Attorney, Agent, or Firm* — Oliff PLC

(57) ABSTRACT

A compact 5G MIMO antenna system includes at least two antenna assemblies. Each antenna assembly includes a first antenna unit and a second antenna unit, wherein the first antenna unit includes a first radiation assembly, a first feed branch and a ground branch; the second antenna unit includes a second radiation assembly, a second feed branch and the ground branch; the ground branch is located between the first radiation assembly and the second radiation assembly; the first feed branch is arranged close to an end, away from the ground branch, of the first radiation assembly; and the second feed branch is arranged close to an end, away from ground branch, of the second radiation assembly. The antenna system improves the isolation between the first
(Continued)

antenna unit and the second antenna unit and compacts the overall structure of the antenna assembly, which has simple structure, high antenna efficiency, and convenient use.

13 Claims, 11 Drawing Sheets

(30) Foreign Application Priority Data

Mar. 1, 2019 (CN) ..... 201920268001.2
May 16, 2019 (CN) ..... 201920717346.1

(51) Int. Cl.
*H01Q 5/50* (2015.01)
*H01Q 1/48* (2006.01)
*H01Q 1/52* (2006.01)

(56) References Cited

U.S. PATENT DOCUMENTS

| | | | | |
|---|---|---|---|---|
| 11,139,571 | B2 * | 10/2021 | Wu | H01Q 5/385 |
| 2014/0191918 | A1 * | 7/2014 | Cheng | H01Q 21/205 343/834 |
| 2015/0002359 | A1 | 1/2015 | Dong et al. | |
| 2015/0162665 | A1 * | 6/2015 | Boryssenko | H01Q 9/26 343/797 |
| 2017/0162948 | A1 * | 6/2017 | Wong | H01Q 21/06 |
| 2017/0194717 | A1 | 7/2017 | Kosaka et al. | |
| 2020/0243984 | A1 * | 7/2020 | Ren | H01Q 1/243 |

* cited by examiner

COMPACT 5G MIMO ANTENNA SYSTEM AND MOBILE TERMINAL

TECHNICAL FIELD

The invention relates to the technical field of antennas, in particular to a compact 5G MIMO antenna system and a mobile terminal.

BACKGROUND ART

With the rapid development of the wireless communication technology, fifth-generation (5G) wireless communication systems will be commercially used in 2020. The 5G wireless communication systems mainly operate within two different frequency bands: the frequency band below 6 GHz and the millimeter wave frequency band above 6 GHz, wherein 5G antenna systems below 6 GHz will be preferential options because of their good operability operation and mature technology.

In the fourth-generation (4G) mobile communication systems, 2*2 multiple-input multiple-output (MIMO) antenna systems have been widely studied and applied to handheld devices. According to present research results from all countries, the peak rate of the 5G technology will be increased by tens of times compared to the existing 4G technology. In order to meet the requirement for the 5G transmission rate, an antenna system including four or more antenna units will be adopted to fulfill a greater channel capacity and better communication quality. In addition, the MIMO antenna system including multiple antenna units can solve the problem of multi-path fading and improve the data throughout.

Due to space limitations of the handheld devices such as mobile phones, how to design a compact antenna structure capable of covering multiple frequency bands is one challenge encountered when MIMO antenna systems are designed. In addition, with the increase of the number of antennas, another challenge encountered in design of the MIMO antenna systems is how to realize good isolation (for instance, superior to 15 dB) of the MIMO antenna systems. Solutions to the reduction of the isolation between the antennas have been widely studied and discussed. For instance, isolation strips are added between two adjacent antenna units, slots are formed in the PCB of the system, decoupling networks are adopted, and neutralization lines having an isolation effect are added between the antenna units. However, no matter which one of these designs is adopted, the complexity and design difficulty of the antennas will be increased, and debugging in the later stage will become more difficult.

BRIEF SUMMARY OF THE INVENTION

The technical issue to be settled by the invention is to provide a compact 5G MIMO antenna system which is capable of covering multiple frequency bands, small in space occupation and capable of realizing good isolation between antenna units, and to provide a mobile terminal.

One technical solution adopted by the invention to settle the above technical issue is as follows:

A compact 5G MIMO antenna system comprises at least two antenna assemblies. Each antenna assembly comprises a first antenna unit and a second antenna unit, wherein the first antenna unit comprises a first radiation assembly, a first feed branch and a ground branch; the second antenna unit comprises a second radiation assembly, a second feed branch and the ground branch; the ground branch is located between the first radiation assembly and the second radiation assembly; the first feed branch is arranged close to an end, away from the ground branch, of the first radiation assembly; and the second feed branch is arranged close to an end, away from the ground branch, of the second radiation assembly.

Furthermore, the first radiation assembly comprises a first radiation branch, and the second radiation assembly comprises a second radiation branch.

Furthermore, the first radiation assembly further comprises a third radiation branch corresponding to the first radiation branch, and the second radiation assembly further comprises a fourth radiation branch corresponding to the second radiation branch.

Furthermore, a first slot is formed in an end, close to the first feed branch, of the first radiation assembly, the first feed branch is provided with a first feed point, and the first slot is close to the first feed point; and a second slot is formed in an end, close to the second feed branch, of the second radiation assembly, the second feed branch is provided with a second feed point, and the second slot is close to the second feed point.

Furthermore, a third slot is formed in an end, close to the ground branch, of the first radiation assembly, the ground branch is provided with a ground point, and the third slot is close to the ground point.

Furthermore, the first radiation branch and the second radiation branch are in an n shape or in an arc shape.

Furthermore, the third radiation branch and the fourth radiation branch are in a u shape or in an arc shape.

Furthermore, the first feed branch and the second feed branch are in a linear shape or in an arc shape.

Furthermore, the first radiation assembly and the second radiation assembly are symmetrically arranged with respect to the ground branch.

Furthermore, the first feed branch and the second feed branch are symmetrically arranged with respect to the ground branch.

Furthermore, each antenna assembly further comprises an antenna bracket, and the first radiation assembly, the second radiation assembly, the ground branch, the first feed branch and the second feed branch are all located on one side of the antenna bracket.

Another technical solution adopted by the invention is as follows:

A mobile terminal comprises the compact 5G MIMO antenna system.

Furthermore, the mobile terminal further comprises a rectangular PCB, and the antenna assemblies are arranged on long edges of the PCB.

The invention has the following beneficial effects: the first antenna unit and the second antenna unit are grounded in a coupled manner by means of one ground branch, so that the isolation between the first antenna unit and the second antenna unit is improved, and the overall structure of the antenna assembly is more compact. The antenna system of the invention is simple in structure, high in antenna efficiency, and convenient to use.

REFERENCE SIGNS

Figure 1:
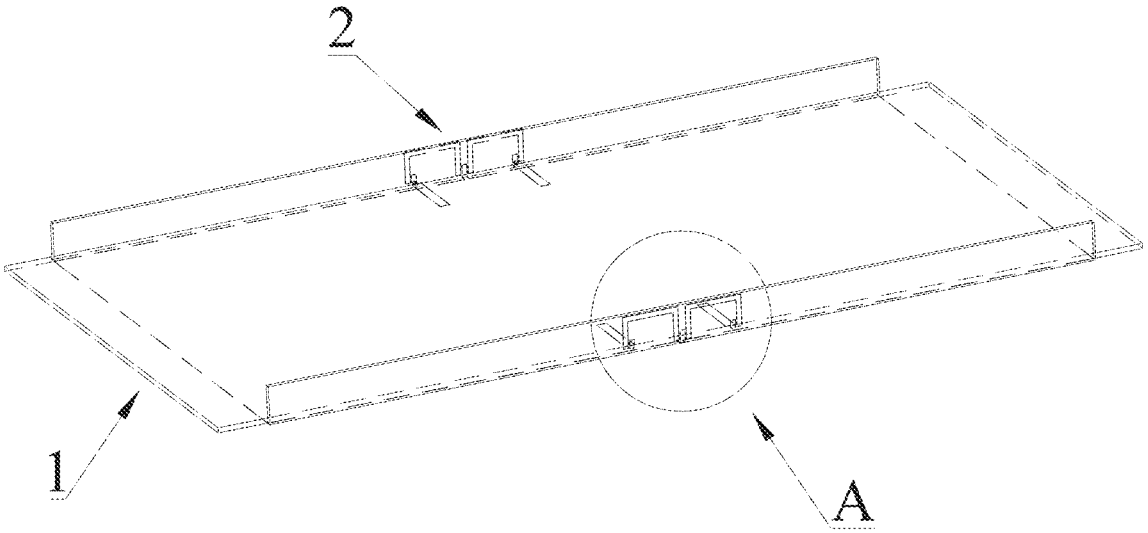
FIG. 1 is a structural diagram of a mobile terminal in Embodiment 1 of the invention.

1, PCB; 2, antenna assembly; 20, first radiation branch; 201, first vertical part; 202, first horizontal part; 203, second vertical part; 21, second radiation branch; 22, ground branch; 221, ground point; 23, first feed branch; 231, first feed point; 24, third radiation branch; 25, fourth radiation branch; 26, second feed branch; 261, second feed point; 27, antenna bracket; 28 first slot; 29, second slot; 30, third slot; 3, micro-strip line; 4, ground plate.

DETAILED DESCRIPTION OF THE INVENTION

The technical contents, objectives and effects of the invention are detailed below in combination with embodiments and accompanying drawings.

The key concept of the invention lies in that a first antenna unit and a second antenna unit are grounded in a coupled manner by means of one ground branch, so that the isolation between the first antenna unit and the second antenna is improved, and the overall structure of an antenna assembly is more compact.

Referring to FIG. 1-FIG. 4 and FIG. 12-FIG. 15, a compact 5G MIMO antenna system comprises at least two antenna assemblies 2. Each antenna assembly 2 comprises a first antenna unit and a second antenna unit, wherein the first antenna unit comprises a first radiation assembly, a first feed branch 23 and a ground branch 22; the second antenna unit comprises a second radiation assembly, a second feed branch 26 and the ground branch 22; the ground branch 22 is located between the first radiation assembly and the second radiation assembly; the first feed branch 23 is arranged close to an end, away from the ground branch 22, of the first radiation assembly; and the second feed branch 26 is arranged close to an end, away from the ground branch 22, of the second radiation assembly.

From the above description, the invention has the following beneficial effects: the first antenna unit and the second antenna unit are grounded in a coupled manner by means of one ground branch, so that the isolation between the first antenna unit and the second antenna unit is improved, and the overall structure of the antenna assembly is more compact. The antenna system of the invention is simple in structure, high in antenna efficiency, and convenient to use. The specific structure of the first radiation assembly and the second radiation assembly can be configured as demanded to fulfill a single-frequency or double-frequency property of the antenna system within the 5G frequency band.

Furthermore, the first radiation assembly comprises a first radiation branch 20, and the second radiation assembly comprises a second radiation branch 21.

From the above description, in the case where the first radiation assembly and the second radiation assembly are each provided with one radiation branch, a single-frequency effect is fulfilled.

Furthermore, the first radiation assembly further comprises a third radiation branch 24 corresponding to the first radiation branch 20, and the second radiation assembly further comprises a fourth radiation branch 25 corresponding to the second radiation branch 21.

From the above description, in the case where the first radiation assembly and the second radiation assembly are each provided with two radiation branches, a dual-frequency effect is fulfilled.

Furthermore, a first slot 28 is formed in an end, close to the first feed branch 23, of the first radiation assembly, the first feed branch 23 is provided with a first feed point 231, and the first slot 28 is close to the first feed point 231; and a second slot 29 is formed in an end, close to the second feed branch 26, of the second radiation assembly, the second feed branch 26 is provided with a second feed point 261, and the second slot 29 is close to the second feed point 261.

From the above description, the first slot is a gap between the first radiation branch and the third radiation branch, and the second slot is a gap between the second radiation branch and the fourth radiation branch.

Furthermore, a third slot 30 is formed in an end, close to the ground branch 22, of the first radiation assembly, the ground branch 22 is provided with a ground point 221, and the third slot 30 is close to the ground point 221.

Furthermore, the first radiation branch 20 and the second radiation branch 21 are in an n shape or in an arc shape.

From the above description, the shape of the first radiation branch and the second radiation branch can be set as demanded.

Furthermore, the third radiation branch 24 and the fourth radiation branch 25 are in a u shape or an arc shape.

From the above description, the shape of the third radiation branch and the fourth radiation branch can be set as demanded.

Furthermore, the first feed branch 23 and the second feed branch 26 are in a linear shape or in an arc shape.

Furthermore, the first radiation assembly and the second radiation assembly are symmetrically arranged with respect to the ground branch 22.

Furthermore, the first feed branch 23 and the second feed branch 26 are symmetrically arranged with respect to the ground branch 22.

From the above description, the first radiation assembly and the second radiation assembly are arranged symmetrically, and the first feed branch and the second feed branch are also arranged symmetrically, so that the two adjacent antenna units (the first antenna unit and the second antenna unit) can operate within the same frequency band. Clearly, the length of the first feed branch and the length of the second feed branch can be adjusted according to the installation position of the antenna assembly to enable the first antenna unit and the second antenna unit to operate within the same frequency band and to realize good isolation between the first antenna unit and the second antenna unit, and in this case, the first feed branch and the second feed branch may have different lengths.

Furthermore, each antenna assembly 2 further comprises an antenna bracket 27, and the first radiation assembly, the second radiation assembly, the ground branch 22, the first feed branch 23 and the second feed branch 26 are all located on one side of the antenna bracket 27.

From the above description, the antenna bracket is made from FR-4 substrate or is a plastic bracket of LDS antennas. In the case where the antenna bracket is made from FR-4 substrate, the antenna units are PCB antennas. In the case where the antenna bracket is a plastic bracket, the antenna units are FPC antennas or LDS antennas (the LDS antennas should be suitable for laser-etched or chemically-plated special plastic brackets).

Another technical solution adopted by the invention is as follows: A mobile terminal comprises the compact 5G MIMO antenna system.

From the above description, by adoption of the compact dual-band 5G MIMO antenna system, more antenna systems can be configured on the mobile terminal more flexibly.

Furthermore, the mobile terminal further comprises a rectangular PCB, and the antenna assemblies are arranged on long edges of the PCB.

Embodiment 1

Figure 2:
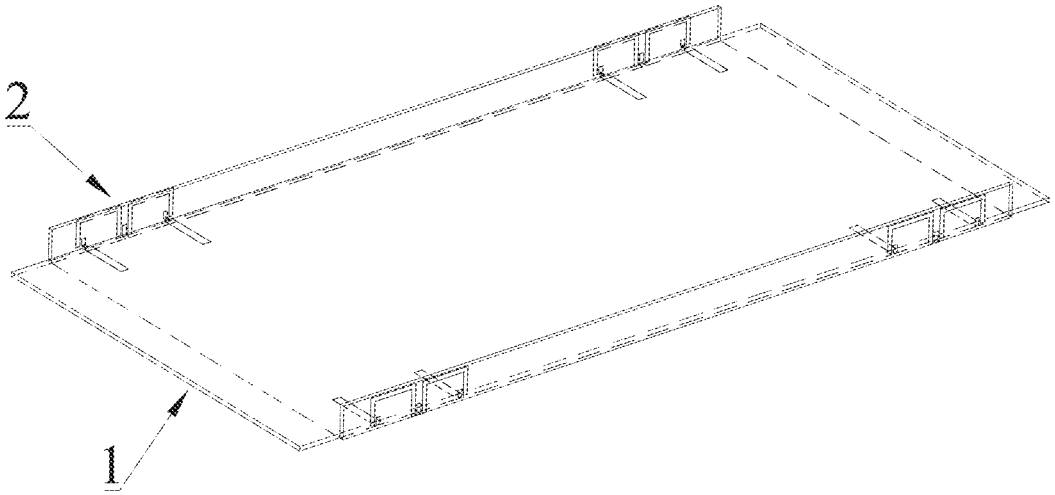
FIG. 2 is another structural diagram of the mobile terminal in Embodiment 1 of the invention.

Referring to FIG. 1-FIG. 11, Embodiment 1 of the invention is as follows:

A mobile terminal comprises a compact 5G MIMO antenna system and a PCB 1, wherein the compact 5G MIMO antenna system comprises at least two antenna assemblies 2 arranged on long edges of the rectangular PCB 1. In this embodiment, the mobile terminal is a handheld device such as a mobile phone or a tablet computer. As shown in FIG. 1, the number of the antenna assemblies 2 is two, and the two antenna assemblies 2 are located at the center of the long edges of the PCB 1. More antenna assemblies 2 can be configured as demanded. As shown in FIG. 2, the number of the antenna assemblies 2 is four, and in this case, the four antenna assemblies 2 are located at the two ends of the long edges of the PCB 1. The dimension of the PCB can be set as demanded. As shown in FIG. 1, the dimension of the PCB 1 is 150 mm*75 mm*0.8 mm.

Figure 3:
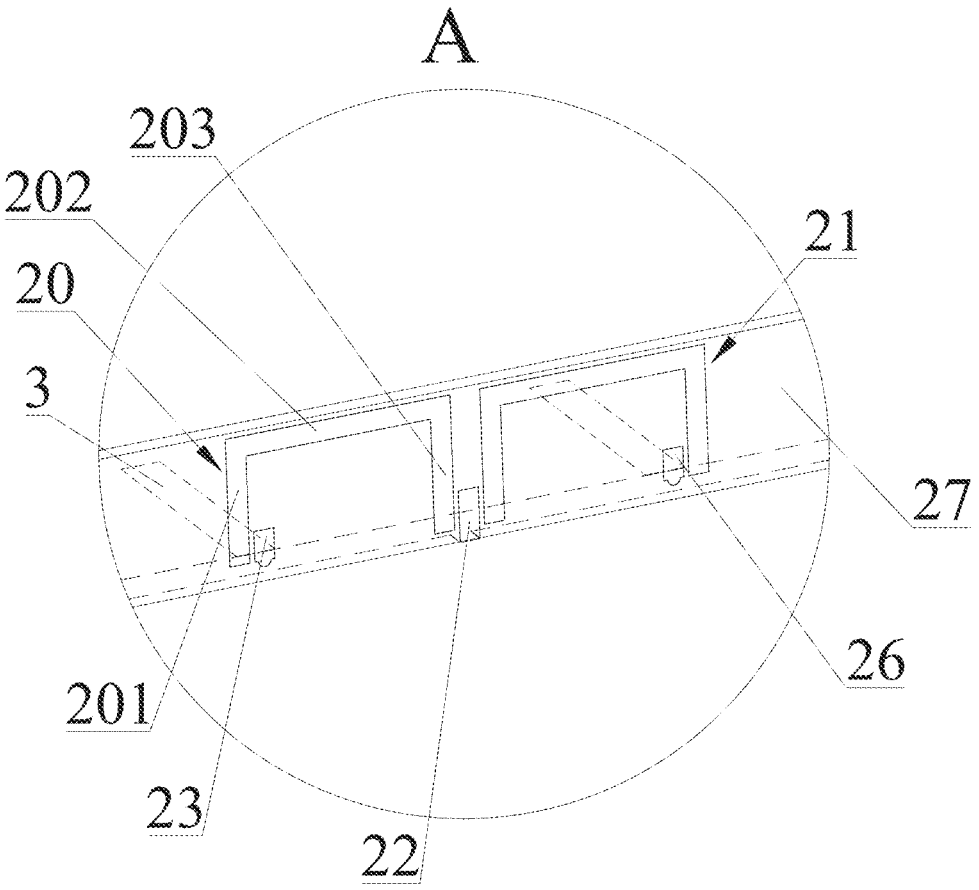
FIG. 3 is an enlarged structural diagram of part A in FIG. 1.
Figure 4:
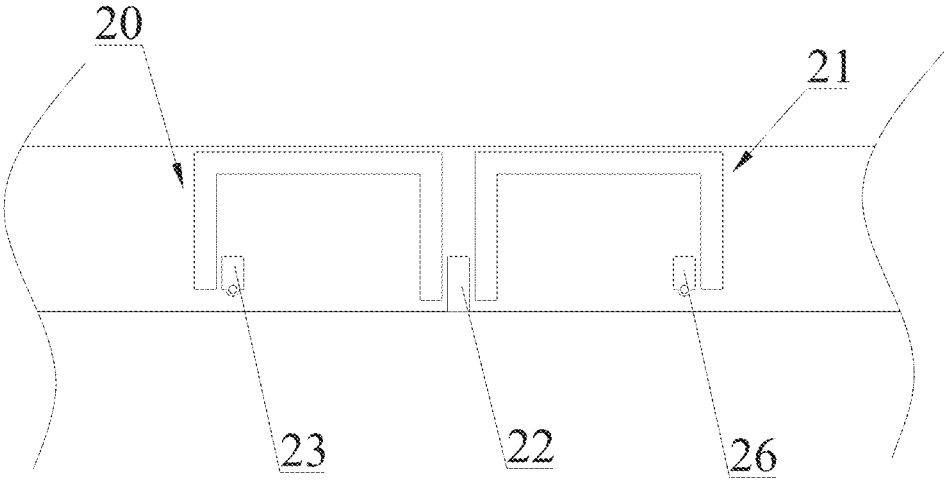
FIG. 4 is a side view of an antenna assembly in Embodiment 1 of the invention.

As shown in FIG. 3 and FIG. 4, each antenna assembly 2 comprises a first antenna unit and a second antenna unit, wherein the first antenna unit comprises a first radiation assembly, a first feed branch 23 and a ground branch 22; the second antenna unit comprises a second radiation assembly, a second feed branch 26 and the ground branch 22; and the first radiation assembly comprises a first radiation branch 20, and the second radiation assembly comprises a second radiation branch 21. Each antenna assembly 2 further comprises an antenna bracket 27. In this embodiment, the first radiation branch 20, the second radiation branch 21, the ground branch 22, the first feed branch 23 and the second feed branch 26 are all located on one side of the antenna bracket 27. The ground branch 22 is located between the first radiation branch 20 and the second radiation branch 21, the first feed branch 23 is arranged close to an end, away from the ground branch 22, of the first radiation branch 20, and the second feed branch 26 is arranged close to an end, away from the ground branch 22, of the second radiation branch 21. Preferably, the first radiation branch 20 and the second radiation branch 21 are symmetrically arranged with respect to the ground branch 22. As for the antenna system shown in FIG. 1, the first feed branch 23 and the second feed branch 26 are also symmetrically arranged with respect to the ground branch 22 in the case where the antenna assemblies 2 are located at the center of the long edges of the PCB 1. As for the antenna system shown in FIG. 2, in the case where the antenna assemblies 2 are located at the two ends of the long edges of the PCB 1, the first feed branch 23 and the second feed branch 26 may have different lengths to enable the first antenna unit and the second antenna unit to operate within the same frequency band and to realize good isolation between the first antenna unit and the second antenna unit, that is to say, the first feed branch 23 and the second feed branch 26 may not symmetrical with respect to the ground branch 22. In this embodiment, the first radiation branch 20 and the second radiation branch 21 are in an n shape. Particularly, the first radiation branch 20 comprises a first vertical part 201, a first horizontal part 202 and a second vertical part 203 which are sequentially connected and are all in a linear shape. The first feed branch 23 and the second feed branch 26 are also in a linear shape, and the shape of the second radiation branch 21 is the same as that of the first radiation branch 20. The first feed branch 23 is arranged on the inner side or the outer side of the first radiation branch 20. Similarly, the second feed branch 26 is arranged on the inner side or the outer side of the second radiation branch 21. In the case where the first feed branch 23 is arranged on the inner side of the first radiation branch 20 and that the second feed branch 26 is arranged on the inner side of the second radiation branch 21, the overall structure of the antenna assembly 2 is more compact. A micro-strip line 3 (50 Ohm) or a coaxial connection line is configured on the PCB 1 to realize electrical connection of the first feed branch 23 and the second feed branch 26 and is electrically connected with the feed branches via metalized holes. The antenna bracket 27 is made from FR-4 substrate or plastic. In the case where the antenna bracket 27 is made from FR-4 substrate, the antenna assembly 2 is a PCB antenna. In the case where the antenna bracket 27 is made from plastic, the antenna assembly 2 is an FPC antenna or an LDS antenna (the LDS antenna should be suitable for laser-etched or chemically-plated special plastic brackets).

In another specific implementation, the first radiation branch 20, the second radiation branch 21, the first feed branch 23 and the second feed branch 26 are in an arc shape.

Figure 5:
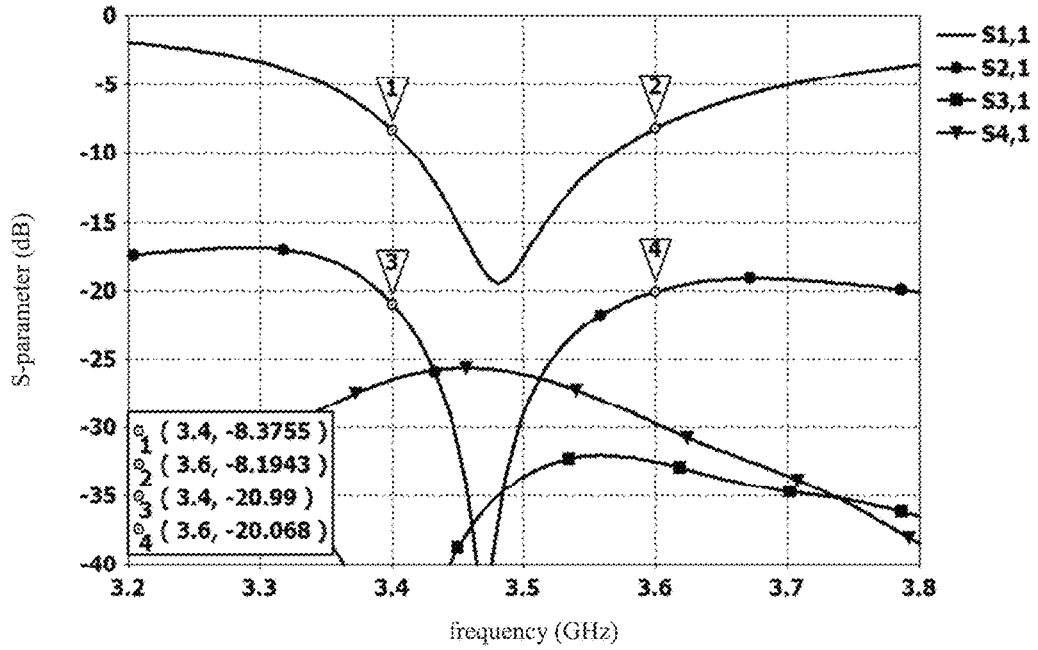
FIG. 5 is an S-parameter diagram of an antenna system in FIG. 1.

FIG. 5 is an S-parameter diagram of the antenna system in FIG. 1. As can be seen from FIG. 5, when the antenna system operates within 3.4-3.6 GHz, the isolation between the antenna units is superior to 20 dB (because the antenna assembly is of a symmetrical structure, only necessary S-parameters are shown in FIG. 5).

Figure 6:
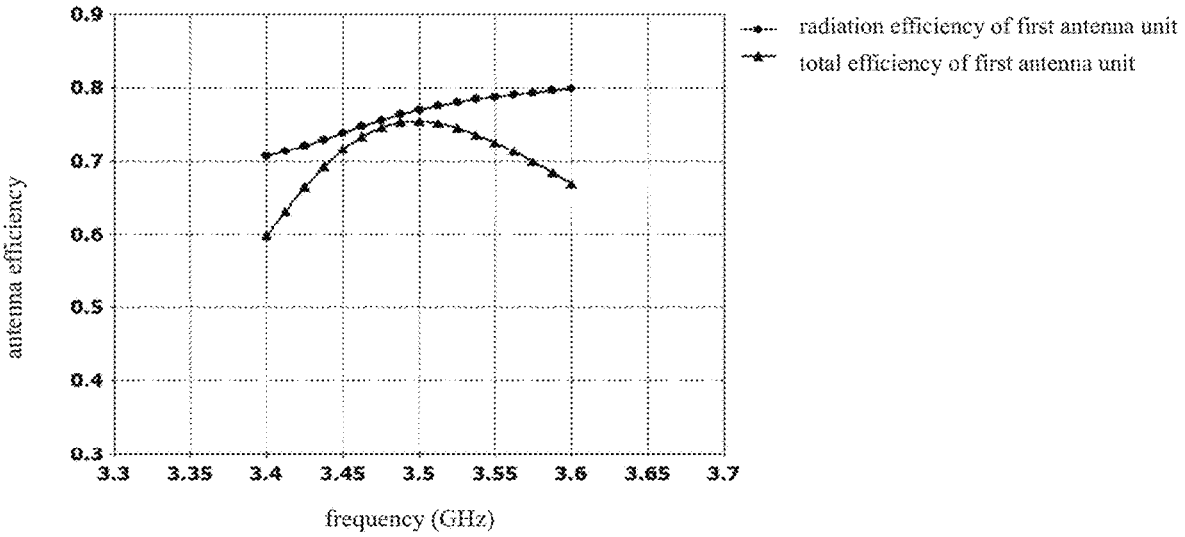
FIG. 6 is an efficiency diagram of antenna units in Embodiment 1 of the invention.

As shown in FIG. 6 which is an efficiency diagram of the antenna units, when the antenna units operate within 3.4-3.6 GHz, the antenna total efficiency is higher than 60%.

Figure 7:
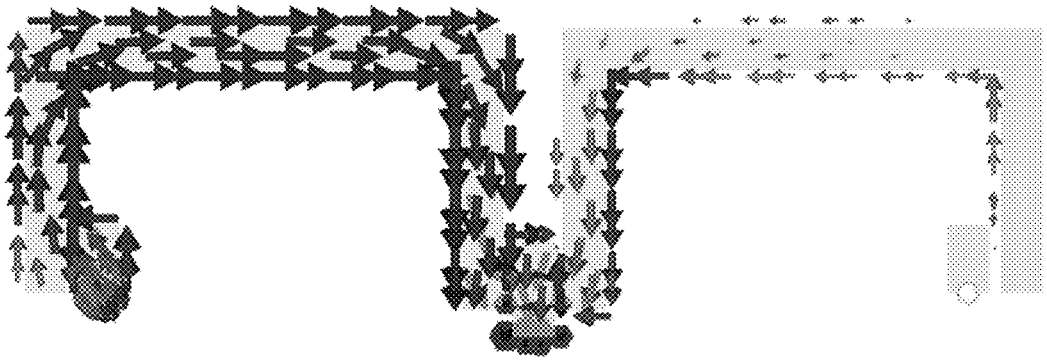
FIG. 7 is a current distribution diagram of a first antenna unit operating at 3.5 GHz in Embodiment 1 of the invention.
Figure 8:
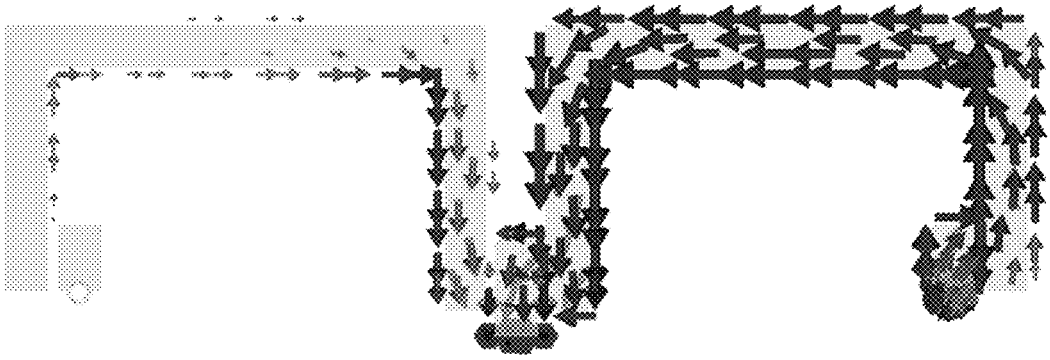
FIG. 8 is a current distribution diagram of a second antenna unit operating at 3.5 GHz in Embodiment 1 of the invention.

For a better explanation of the reason for the good isolation between the two antenna units of the antenna assembly of the invention, a current distribution diagram of the first antenna unit operating at 3.5 GHz and a current distribution diagram of the second antenna unit operating at 3.5 GHz are shown in FIG. 7 and FIG. 8. As can be seen from FIG. 7 and FIG. 8, when the first antenna unit is excited, most currents are concentrated on the three radiation parts of the first radiation branch and the ground branch, and few currents can reach the second feed branch. Meanwhile, when the second antenna unit is excited, few currents can reach the first feed branch. Therefore, good isolation between the first antenna unit and the second antenna unit can also be realized even if the first antenna unit and the second antenna unit are very close to each other.

Figure 9:
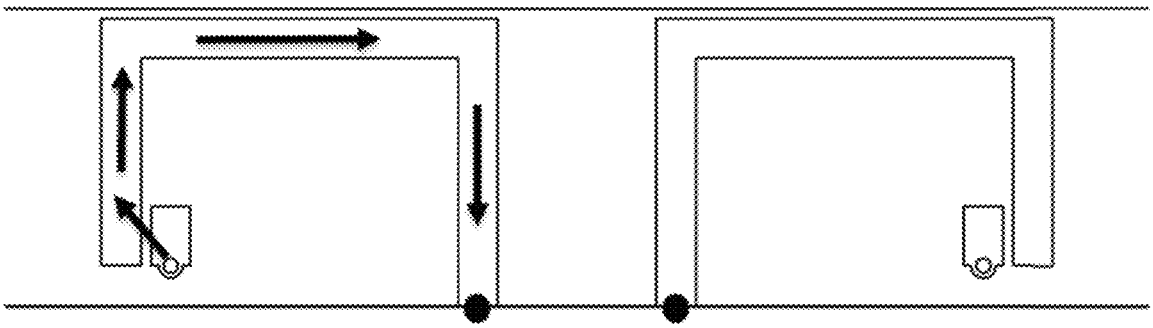
FIG. 9 is a side view of a traditional antenna assembly.
Figure 10:
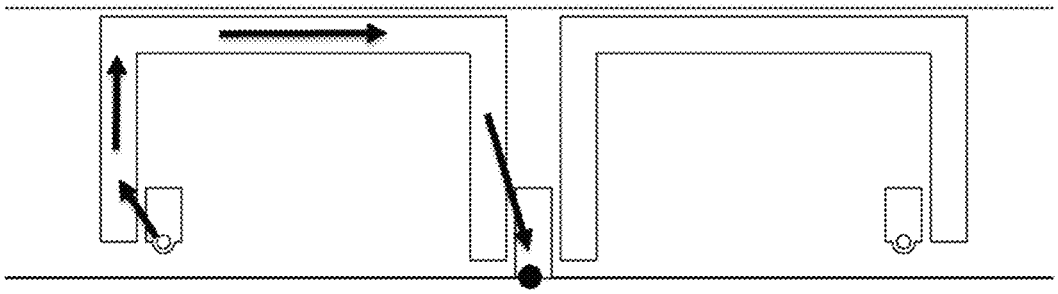
FIG. 10 is another side view of the antenna assembly in Embodiment 1 of the invention.
Figure 11:
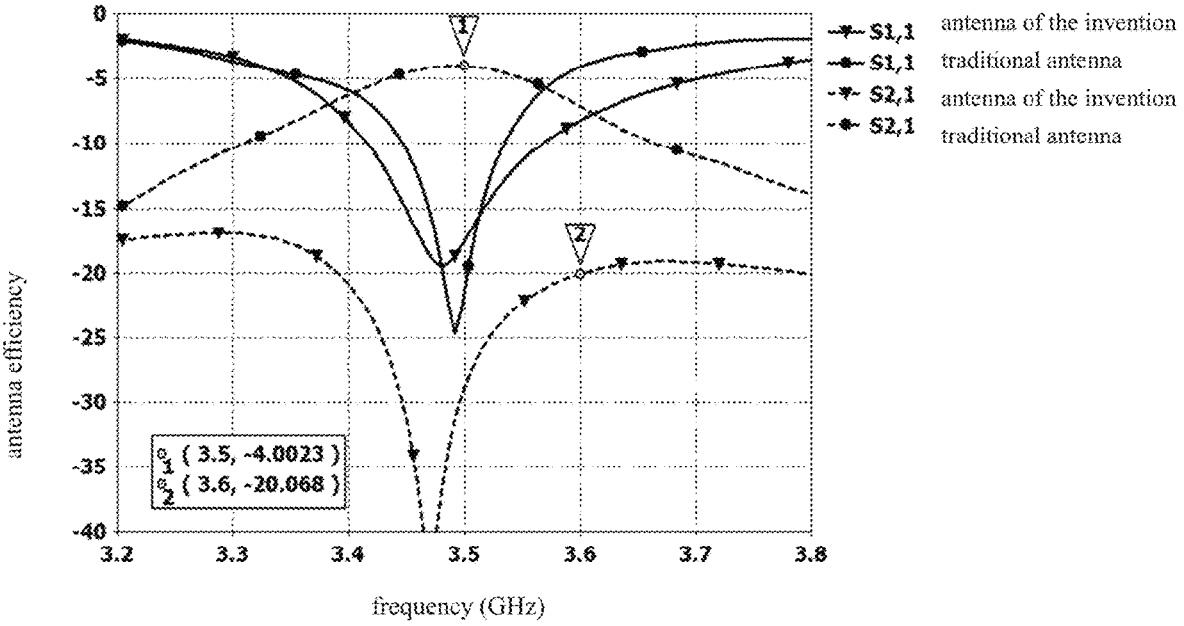
FIG. 11 shows performance comparison results of the antenna system in Embodiment 1 and the traditional antenna system.

For a further explanation of the superiority of the antenna system of the invention, FIG. 9 shows a side view of a traditional antenna assembly, wherein radiation branches of two antenna units of the traditional antenna assembly are independently grounded; FIG. 10 shows a side view of the antenna assembly of the invention; and FIG. 11 shows performance comparison results of the antenna system of the invention and the traditional antenna system, wherein the comparison results are obtained under the condition where the antenna units operate within the same frequency band and the distance between the feed points of the two antenna units is kept consistent. As can be seen from FIG. 9 and FIG. 10, when the first antenna unit of the invention operates, currents pass through the first feed branch first, are then coupled to the first vertical part of the antenna, then pass through the first horizontal part and the second vertical part, and are finally coupled to the ground branch to form a coupled loop antenna. When the first antenna unit of a traditional antenna operates, currents pass through the first feed branch first, are then coupled to the first vertical part of the antenna, and then pass through the first horizontal part and the second vertical part to return to the ground (the PCB). As can be seen from FIG. 11, under the same the distance between the feed points and the same resonant frequency, the isolation between the first antenna unit and the second antenna unit of the traditional antenna is only 4 dB, while the isolation between the first antenna unit and the second antenna unit of the antenna of the invention is improved to 20 dB from 4 dB. In addition, by adoption of the antenna structure of the invention, the first antenna unit and the second antenna unit can be arranged very close to each other, and thus, the flexibility of the overall antenna layout is greatly improved.

In this embodiment, the 5G MIMO antenna system is analyzed and described under the condition where the 5G MIMO antenna system operates within 3.4-3.6 GHz below 6 GHz. However, the antenna design principle of the invention can also be applied to other m*n (in and n are integers which are greater than two) MIMO antenna systems operating in other 5G frequency bands. Meanwhile, any transformations relating to the antenna system described above should also fall within the protection scope of the invention.

Embodiment 2

Figure 12:
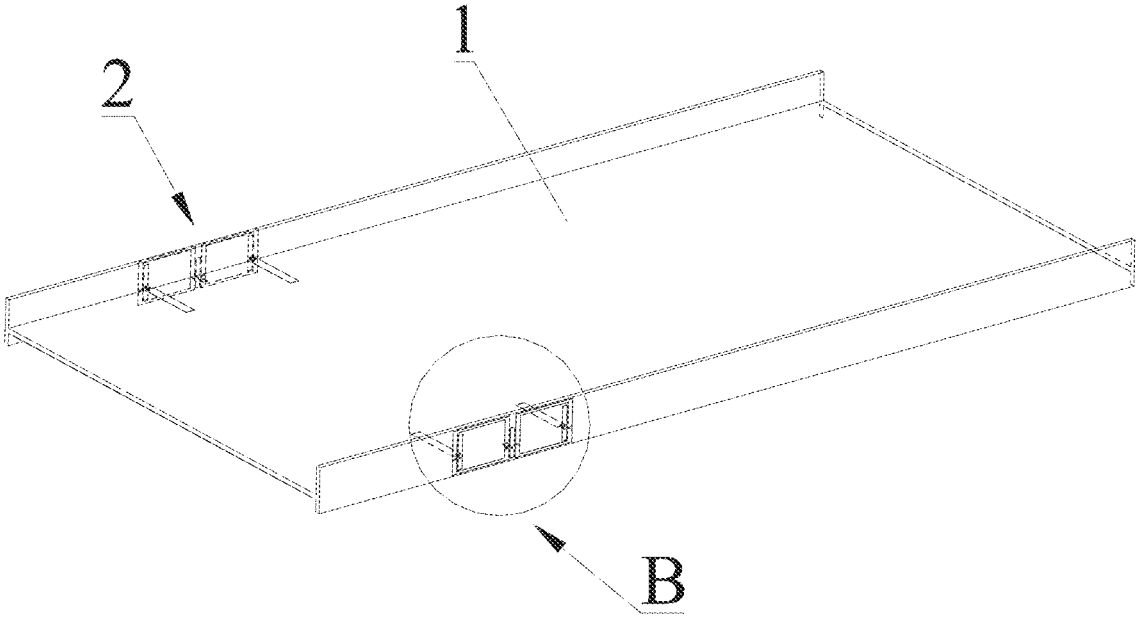
FIG. 12 is a structural diagram of a mobile terminal in Embodiment 2 of the invention.
Figure 13:
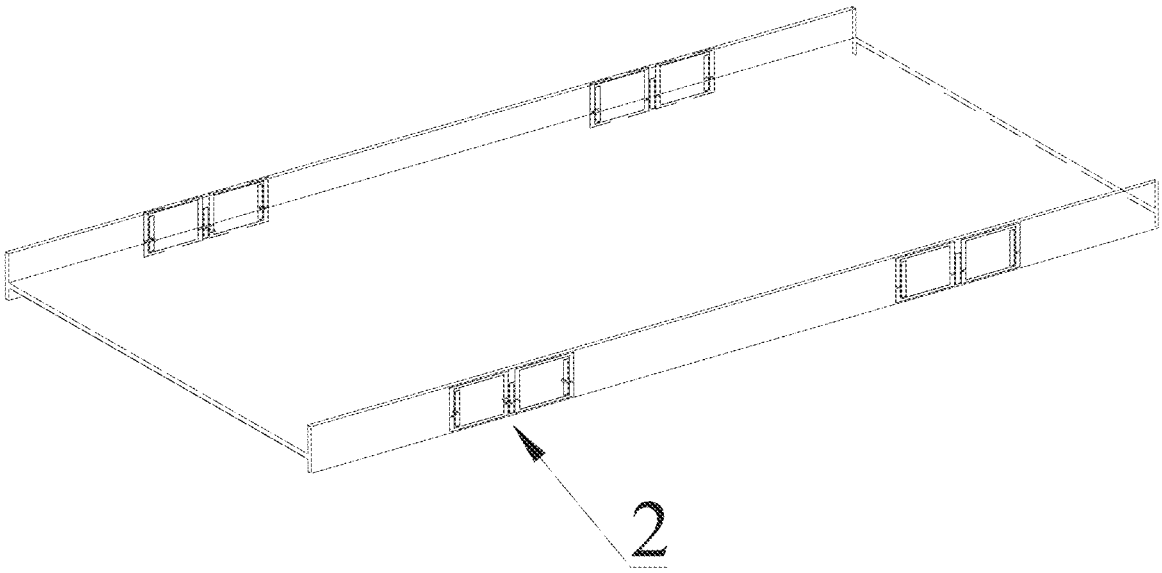
FIG. 13 is another structural diagram of the mobile terminal in Embodiment 2 of the invention.

Referring to FIG. 12-FIG. 23, Embodiment 2 of the invention is as follows: A mobile terminal comprises a compact double-frequency 5G MIMO antenna system and a PCB board 1, wherein the PCB 1 is rectangular and has a dimension of 150 mm*75 mm*0.8 mm, and the compact double-frequency 5G MIMO antenna system comprises at least two antenna assemblies 2 which are arranged on long edges of the PCB 1. In this embodiment, the mobile terminal is a handheld device such as a mobile phone or a tablet computer. As shown in FIG. 12, the number of the antenna assemblies 2 is two, and the two antenna assemblies 2 are symmetrically arranged with respect to short edges of the PCB 1. As shown in FIG. 13, the number of the antenna assemblies 2 is four. Clearly, more antenna assemblies 2 can be configured as demanded. In this embodiment, a ground plate 4 is arranged below the PCB 1, and the PCB 1 is made from FR-4 substrate.

Figure 14:
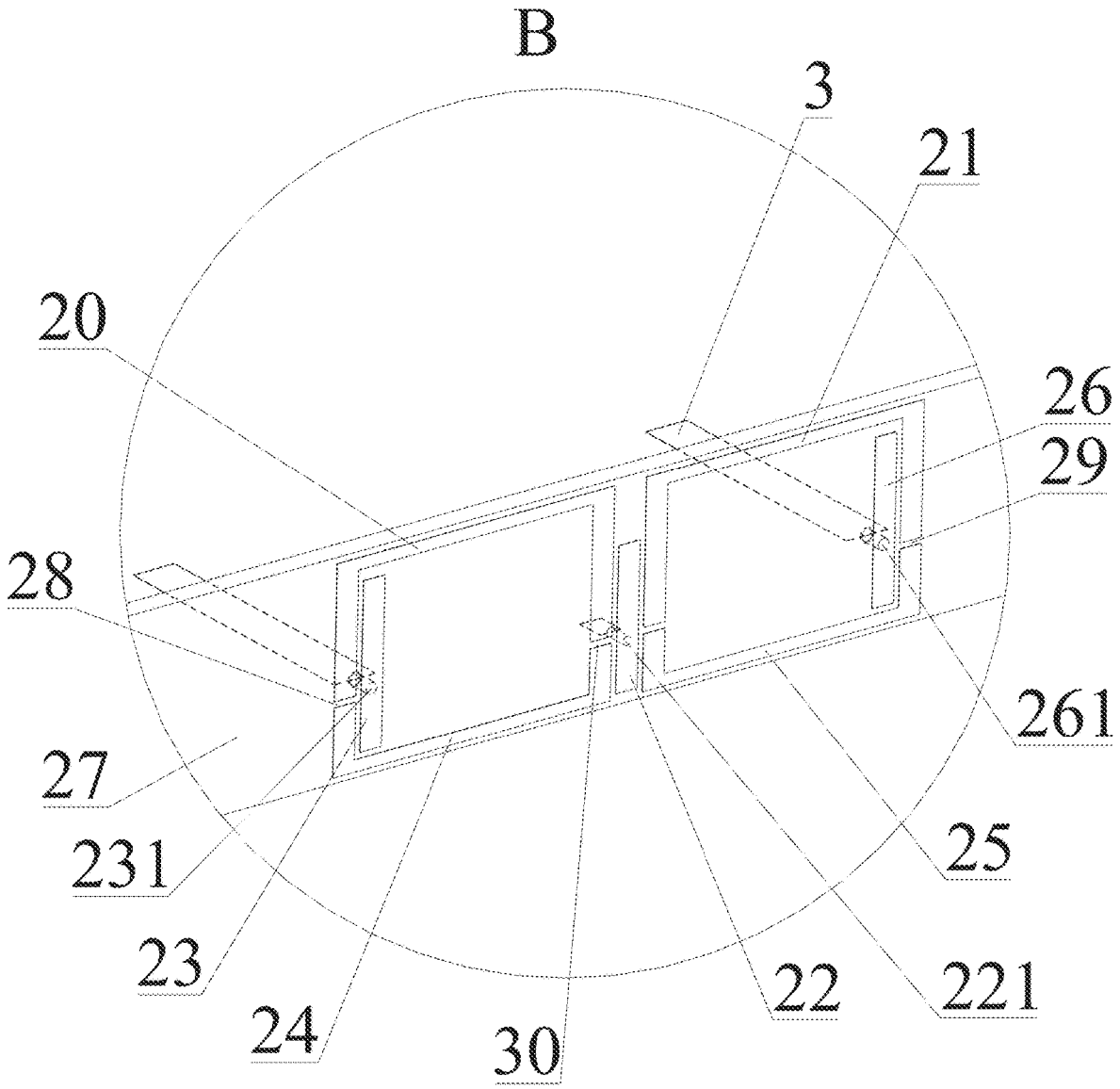
FIG. 14 is an enlarged structural diagram of part B in FIG. 12.
Figure 15:
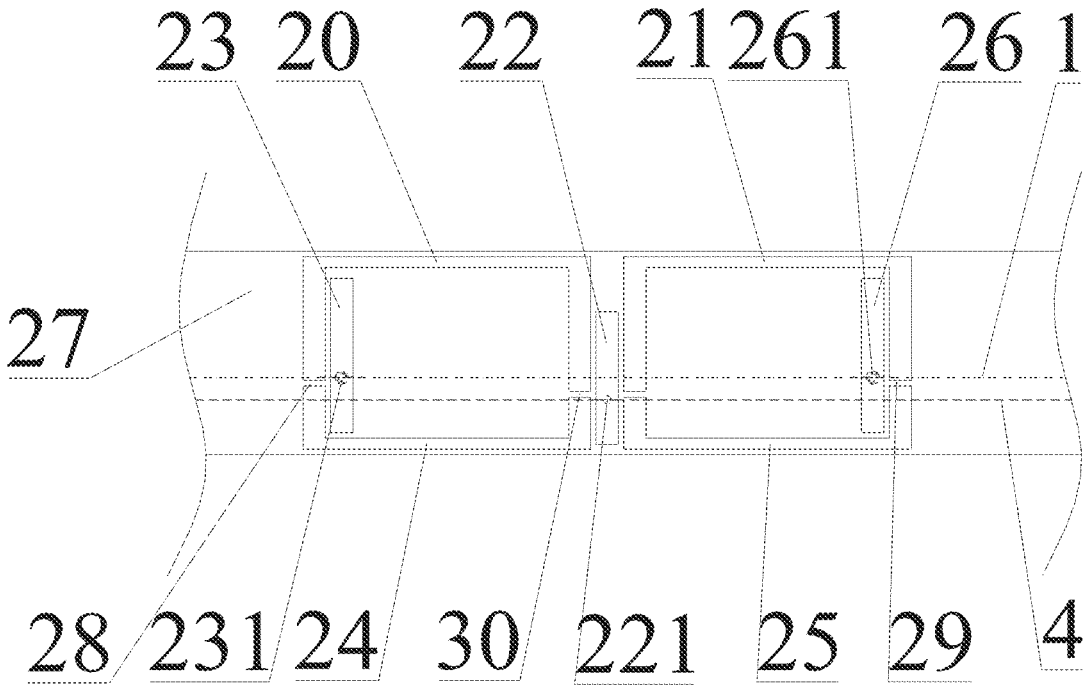
FIG. 15 is a side view of an antenna assembly in Embodiment 2 of the invention.

As shown in FIG. 14 and FIG. 15, each antenna assembly 2 comprises a first antenna unit and a second antenna unit, wherein the first antenna unit comprises a first radiation assembly, a first feed branch 23 and a ground branch 22, the first radiation assembly comprises a first radiation branch 20 and a third radiation branch 24 corresponding to the first radiation branch 20, the first radiation branch 20 is in an n shape, the third radiation branch 24 is in a u shape, and the first radiation branch 20 and the third radiation branch 24 each consist of three sequentially-connected linear radiation parts including two vertical parts and a horizontal part; the second antenna unit comprises a second radiation assembly, a second feed branch 26 and a ground branch 22, the second radiation assembly comprises a second radiation branch 21 and a fourth radiation branch 25 corresponding to the fourth radiation branch 25, the second radiation branch 21 is in an n shape, the fourth radiation branch 25 is in a u shape, and the second radiation branch 21 and the fourth radiation branch 25 each consists of three sequentially-connected linear radiation parts including two vertical parts and a horizontal part; the ground branch 22 is located between the first radiation assembly and the second radiation assembly; the first feed branch 23 is arranged close to an end, away from the ground branch 22, of the first radiation assembly; and the second feed branch 26 is arranged close to an end, away from the ground branch 22, of the second radiation assembly. Preferably, the first radiation assembly and the second radiation assembly are symmetrically arranged with respect to the ground branch 22, and the first feed branch 23 and the second feed branch 26 are also symmetrically arranged with respect to the ground branch 22. In this embodiment, the first feed branch 23 and the second feed branch 26 are in a linear shape. The first feed branch 23 is arranged on the inner side or the outer side of the first radiation assembly, and similarly, the second feed branch 26 is arranged on the inner side or the outer side of the second radiation assembly. In the case where the first feed branch 23 is arranged on the inner side of the first radiation assembly and the second feed branch 26 is arranged on the inner side of the second radiation assembly, the overall structure of the antenna assembly 2 is more compact. In this embodiment, the antenna assembly 2 further comprises an antenna bracket 27, and the first radiation assembly, the second radiation assembly, the ground branch 22, the first feed branch 23 and the second feed branch 26 are located on one side of the antenna bracket 27. A first slot 28 is formed in an end, close to the first feed branch 23, of the first radiation assembly, the first feed branch 23 is provided with a first feed point 231, and the first slot 28 is close to the first feed point 231 and is a horizontal gap between the first radiation branch 20 and the third radiation branch 24. A second slot 29 is formed in an end, close to the second feed branch 26, of the second radiation assembly, the second feed branch 26 is provided with a second feed point 261, and the second slot 29 is close to the second feed point 261 and is a horizontal gap between the second radiation branch 21 and the fourth radiation branch 25. A micro-strip line 3 (50 Ohm) or a coaxial connection line is configured on the PCB 1 to realize electrical connection of the first feed branch 23 and the second feed branch 26 and is electrically connected with the feed branches via metalized holes. A third slot 30 is formed in an end, close to the ground branch 22, of the first radiation assembly, the ground branch 22 is provided with a ground point 221, the third slot 30 is arranged close to the ground point 221 and is also a horizontal gap, and the ground point 221 is electrically connected with the metal ground plate 4 via a metalized hole. Because the first radiation assembly and the second radiation assembly are symmetrically arranged with respect to the ground branch 22, a fourth slot is actually formed in an end, close to the round branch 22, of the second radiation assembly, and the fourth slot and the third slot 30 are also symmetrical with respect to the ground branch 22.

In another specific implementation, the first radiation branch 20, the second radiation branch 21, the third radiation branch 24, the fourth radiation branch 25, the first feed branch 23 and the second feed branch 26 are all in an arc shape. The parameters, such as the radian and the length, of the branches can be adjusted to enable the antenna system to operate within the corresponding frequency band.

Figure 16:
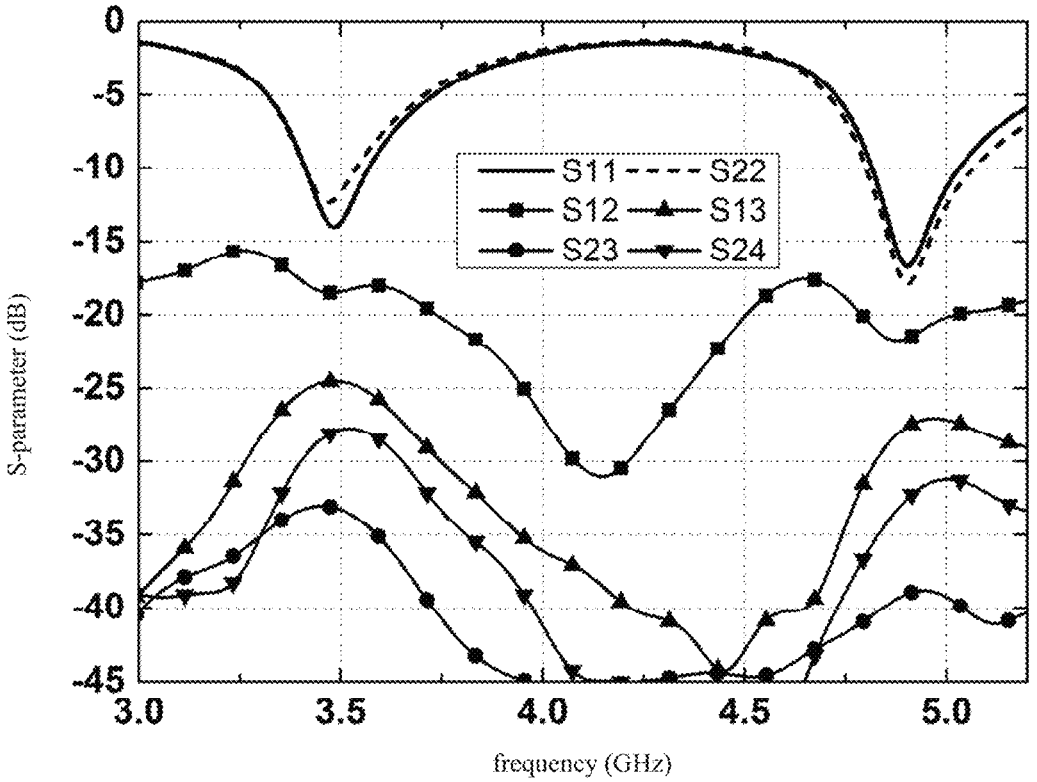
FIG. 16 is an S-parameter diagram of the antenna system in FIG. 12.

FIG. 16 is an S-parameter diagram of the antenna system in FIG. 12. As can be seen from FIG. 16, when the antenna system operates within 3.4-3.6 GHz, the isolation between the antenna units is superior to 17.5 dB; and when the antenna system operates within 4.8-5 GHz, the isolation between the antenna units is superior to 20 dB (because the MIMO antenna system is of a symmetrical structure, only necessary S-parameters are shown in FIG. 16).

Figure 17:
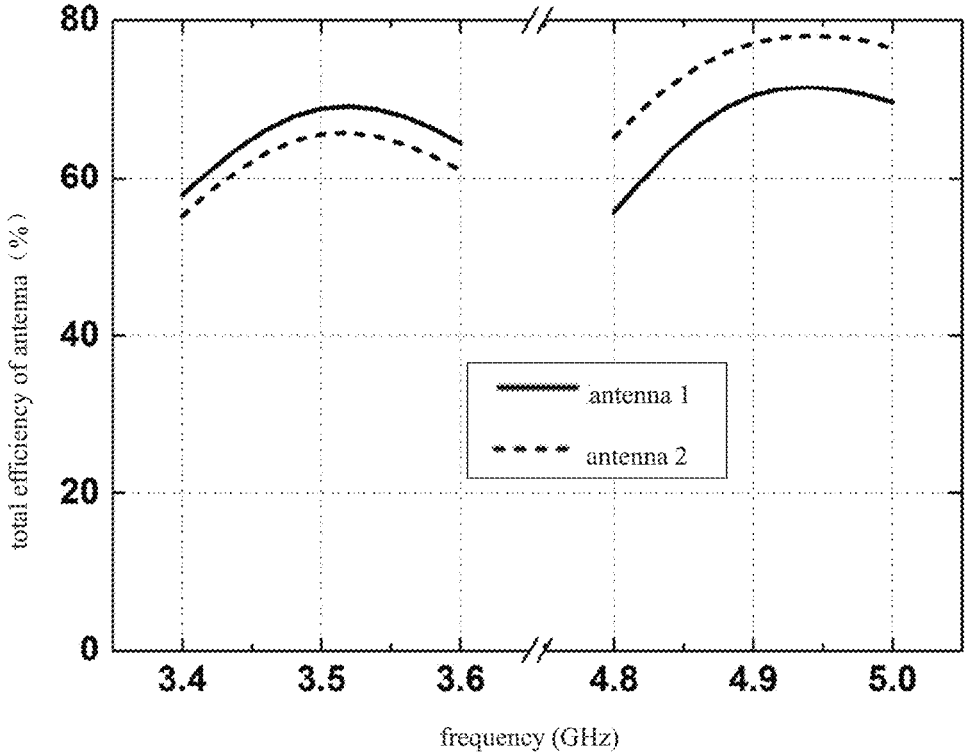
FIG. 17 is an total efficiency diagram of the antenna system in FIG. 12.

FIG. 17 is a total efficiency diagram of the antenna system in FIG. 12. In FIG. 17, antenna 1 refers to the first antenna unit, and antenna 2 refers to the second antenna unit. As can be seen from FIG. 17, when the antenna system operates within 3.4-3.6 GHz, the total efficiency ranges from 55% to 69%; and when the antenna system operates within 4.8-5.0 GHz, the total efficiency ranges from 55% to 78%.

Figure 18:
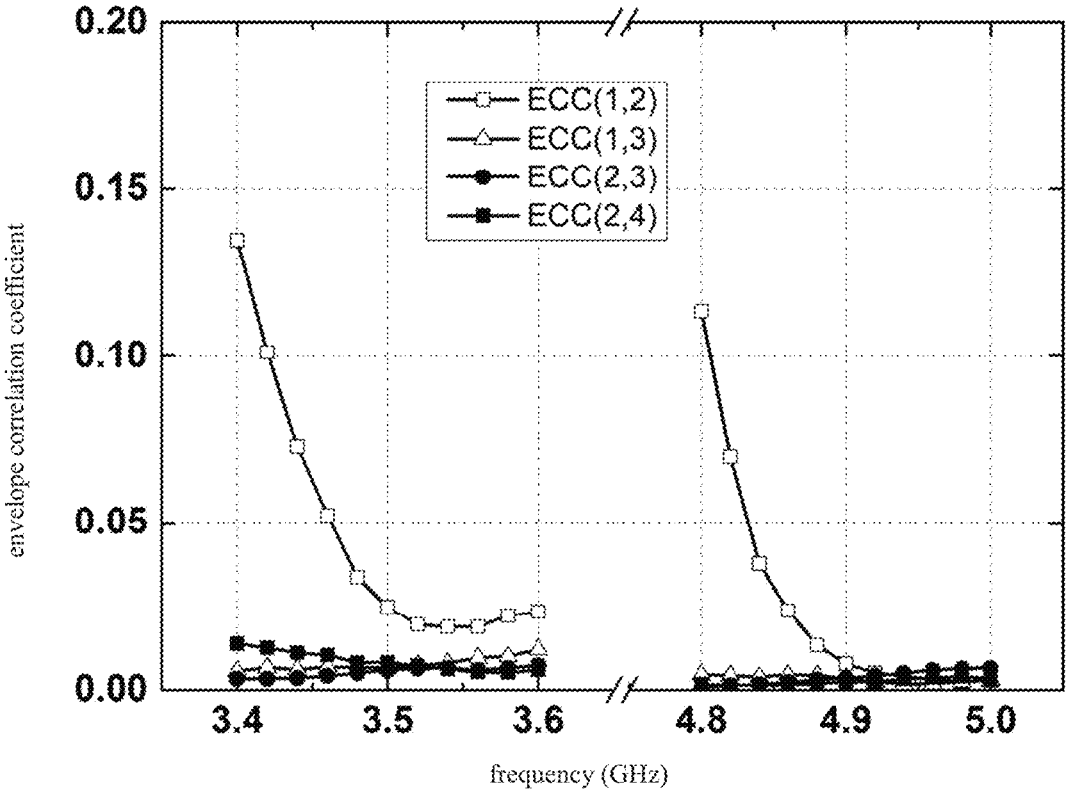
FIG. 18 shows the envelope correlation coefficient (ECC) of the antenna system in FIG. 12.

FIG. 18 shows the envelope correlation coefficient (ECC) of the antenna system in FIG. 12. As can be seen from FIG. 18, the ECC between the two antenna units within the two frequency bands is smaller than 0.15.

Figure 19:
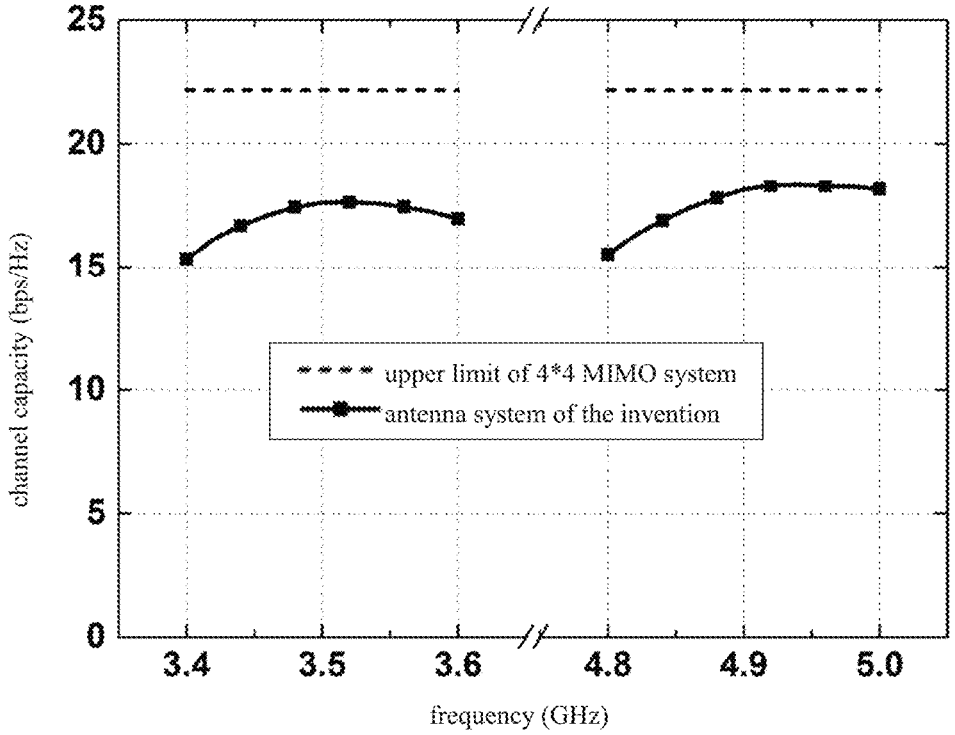
FIG. 19 shows channel capacity test results of a 4*4 MIMO antenna system.

The channel capacity is a key parameter for evaluating MIMO antenna systems, and the antenna efficiency should be taken into consideration when the channel capacity of the MIMO antenna systems is calculated. Suppose receiving antennas are non-correlated and are in a good condition and the four MIMO antennas are used as transmitting antennas, a 4*4 MIMO transmission system provided with four transmitting antennas and four receiving antennas is formed. Suppose the transmitting power is equally distributed, the channels are independent identically-distributed Rayleigh fading channels, the channel state information is unknown, and the receiving signal noise ratio (SNR) is 20 dB. FIG. 19 shows the channel capacity of the double-frequency 4*4 MIMO antenna system (including two antenna assemblies), and the results in FIG. 19 are obtained on the basis of 10000 random channel capacity samples. As can be seen from FIG. 19, the channel capacity can reach 15.5-18.3 bps/Hz within the operating frequency band of the MIMO antenna systems, the ideal channel capacity of the 4*4 MIMO antenna system is 22 bps/Hz, and thus, the MIMO antenna system provided by the invention is suitable for 5G mobile communication devices.

Figure 20:
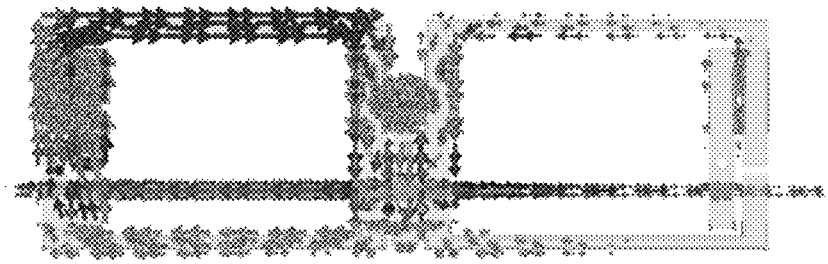
FIG. 20 is a current distribution diagram of a first antenna unit operating at 3.5 GHz in Embodiment 2 of the invention.
Figure 21:
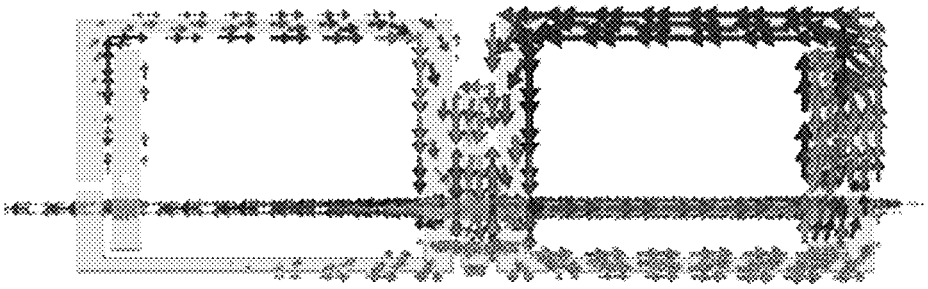
FIG. 21 is a current distribution diagram of a second antenna unit operating at 3.5 GHz in Embodiment 2 of the invention.

For a better explanation of the reason for the good isolation between the two antenna units of the antenna assembly of the invention, FIG. 20 shows a current distribution diagram of the first antenna unit operating at 3.5 GHz, and FIG. 21 shows a current distribution diagram of the second antenna unit operating at 3.5 GHz. As can be seen from FIG. 20 and FIG. 21, when the first antenna unit is excited, most currents are concentrated on the upper portion of the first feed branch of the antenna unit, the first radiation branch and the upper portion of the ground branch, and few currents can reach the second feed branch of the second antenna unit. When the second antenna unit is excited, the currents are distributed in the same way. Therefore, when the antenna assembly in this embodiment operates at a low frequency, good isolation between the first antenna unit and the second antenna unit can also be realized even if the first antenna unit and the second antenna unit are very close to each other.

Figure 22:
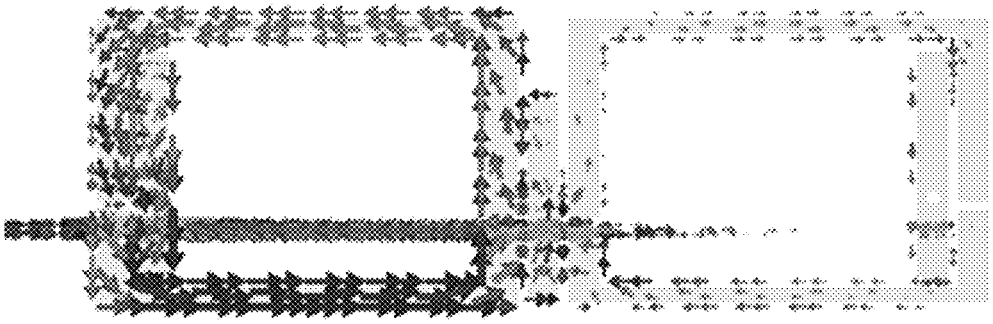
FIG. 22 is a current distribution diagram of a first antenna unit operating at 4.9 GHz in Embodiment 2 of the invention.
Figure 23:
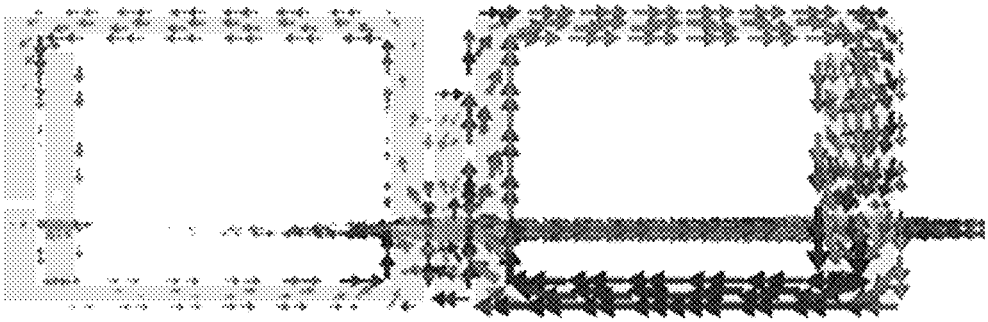
FIG. 23 is a current distribution diagram of the second antenna unit operating at 4.9 GHz in Embodiment 2 of the invention.

FIG. 22 shows the current distribution diagrams of the first antenna unit operating at 4.9 GHz, and FIG. 23 shows the current distribution diagrams of the second antenna unit operating at 4.9 GHz. As can be seen from FIG. 22 and FIG. 23, when the first antenna unit is excited, most currents are concentrated on the lower portion of the first feed branch, the third radiation branch and the lower portion of the ground branch, while few currents can reach the feed branch of the second antenna unit. When the second antenna unit is excited, the currents are distributed in the same way. Therefore, when the antenna assembly operates at a high frequency, good isolation can also be realized even if the first antenna unit and the second antenna unit are very close to each other.

In this embodiment, the 5G MIMO antenna system is analyzed and described under the condition where the 5G MIMO antenna system operates within the frequency band 3.4-3.6 GHz and the frequency band 4.8-5.0 GHz below 6 GHz. However, the antenna design principle of the invention can also be applied to other m*n (in and n are integers which are greater than two) MIMO antenna systems operating in other 5G frequency bands. Meanwhile, any transformations relating to the antenna system described above should also fall within the protection scope of the invention.

According to the compact 5G MIMO antenna system and the mobile terminal of the invention, the antenna units are simple in structure, the isolation between the adjacent antenna units is good, and the antenna efficiency is high; and the compact 5G MIMO antenna system can cover one or both of the frequency band 3.4-3.6 GHz and the frequency band 4.8-5.0 GHz and is convenient to use.

The above embodiments are only illustrative ones of the invention, and are not intended to limit the patent scope of the invention. All equivalent transformations achieved based on the specification and accompanying drawings of the invention, or direct or indirect applications to relevant technical fields should also fall within the patent protection scope of the invention.

The invention claimed is:

1. A compact 5G multiple-input multiple-output (MIMO) antenna system, comprising:

at least two antenna assemblies, each antenna assembly comprising a first antenna unit and a second antenna unit, wherein the first antenna unit comprises:

a ground branch;

a first radiation assembly comprising a first radiation branch, the first radiation branch having a first vertical part, a first horizontal part, and a second vertical part, which are sequentially connected to each other, the second vertical part being disposed closer to the ground branch than the first vertical part; and a first feed branch, the second antenna unit comprises:

the ground branch, a second radiation assembly comprising a second radiation branch, the second radiation branch having a third vertical part, a second horizontal part, and a fourth vertical part, which are sequentially connected to each other, the fourth vertical part being disposed closer to the ground branch than the third vertical part; and a second feed branch, the ground branch is disposed between the second vertical part of the first radiation branch and the fourth vertical part of the second radiation branch, the first feed branch is disposed on one of an inner side or an outer side of the first vertical part of the first radiation branch, and the second feed branch is disposed on one of an inner side or an outer side of the third vertical part of the second radiation branch.

2. The compact 5G MIMO antenna system according to claim 1, wherein the first radiation assembly further comprises a third radiation branch corresponding to the first radiation branch, and the second radiation assembly further comprises a fourth radiation branch corresponding to the second radiation branch.

3. The 5G MIMO antenna system according to claim 2, wherein a first slot is formed in an end, close to the first feed branch, of the first radiation assembly, the first feed branch is provided with a first feed point, and the first slot is close to the first feed branch, and a second slot is formed in an end, close to the second feed branch, of the second radiation assembly, the second feed branch is provided with a second feed point, and the second slot is close to the second feed point.

4. The 5G MIMO antenna system according to claim 2, wherein a third slot is formed in an end, close to the ground branch, of the first radiation assembly, the ground branch is provided with a ground point, and the third slot is close to the ground point.

5. The 5G MIMO antenna system according to claim 1 wherein the first radiation branch and the second radiation branch are in an n shape or in an arc shape.

6. The 5G MIMO antenna system according to claim 2, wherein the third radiation branch and the fourth radiation branch are in a u shape or in an arc shape.

7. The 5G MIMO antenna system according to claim 1, wherein the first feed branch and the second feed branch are in a linear shape or in an arc shape.

8. The 5G MIMO antenna system according to claim 1, wherein the first radiation assembly and the second radiation assembly are symmetrically arranged with respect to the ground branch.

9. The 5G MIMO antenna system according to claim 1, wherein the first feed branch and the second feed branch are symmetrically arranged with respect to the ground branch.

10. The 5G MIMO antenna system according to claim 1, wherein each antenna assembly further comprises an antenna bracket, and the first radiation assembly, the second radiation assembly, the ground branch, the first feed branch and the second feed branch are all located on one side of the antenna bracket.

11. A mobile terminal, comprising the 5G MIMO antenna system according to claim 1.

12. The mobile terminal according to claim 11, wherein the mobile terminal further comprises a rectangular printed circuit board (PCB), and the antenna assemblies are arranged on long edges of the PCB.

13. A mobile terminal, comprising the 5G MIMO antenna system according to claim 2.

* * * * *